US006616547B2

(12) United States Patent
Vincent et al.

(10) Patent No.: US 6,616,547 B2
(45) Date of Patent: Sep. 9, 2003

(54) GOLF CLUB HEAD

(75) Inventors: Benoit Vincent, Leucadia, CA (US); Bret Wahl, Carlsbad, CA (US); Mark Morgulis, San Diego, CA (US); Michael R. Peters, Vista, CA (US); Jean-Pierre Renaudin, Seynod (FR)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 09/907,492

(22) Filed: Jul. 16, 2001

(65) Prior Publication Data

US 2003/0013545 A1 Jan. 16, 2003

Related U.S. Application Data

(62) Division of application No. 09/728,955, filed on Dec. 1, 2000.

(51) Int. Cl.[7] ..... A63B 53/04

(52) U.S. Cl. ..... 473/334; 473/338; 473/345; 473/350

(58) Field of Search ..... 473/324, 326, 473/332, 329, 334, 335, 336, 338, 339, 342, 344, 345, 347, 348, 349, 350, 219, 226, 242, 256, 520; 273/DIG. 8

(56) References Cited

U.S. PATENT DOCUMENTS

| | | | | |
|---|---|---|---|---|
| 1,538,312 | A | * | 5/1925 | Beat |
| 2,163,091 | A | * | 6/1939 | Held |
| 2,198,981 | A | * | 4/1940 | Sullivan |
| 2,328,583 | A | * | 9/1943 | Reach |
| 2,332,342 | A | * | 10/1943 | Reach |
| 2,429,351 | A | * | 10/1947 | Fetterolf |
| D207,228 | S | | 3/1967 | Solheim ..... D34/5 |
| 3,466,047 | A | * | 9/1969 | Rodia |
| 3,606,327 | A | * | 9/1971 | Gorman |
| 3,970,236 | A | * | 7/1976 | Rogers |
| 4,043,563 | A | * | 8/1977 | Churchward |
| D246,329 | S | | 11/1977 | Little |
| 4,085,934 | A | * | 4/1978 | Churchward |
| 4,340,230 | A | | 7/1982 | Churchward |
| 4,398,965 | A | * | 8/1983 | Campau |

(List continued on next page.)

FOREIGN PATENT DOCUMENTS

| | | |
|---|---|---|
| JP | 02-084972 | 3/1990 |
| JP | 10127832 | 5/1998 |
| JP | 2000197718 | 7/2000 |
| JP | 2001-000599 | 1/2001 |
| JP | 2001-037920 | 2/2001 |
| JP | 2001-046560 | 2/2001 |
| JP | 2001-095959 | 4/2001 |
| JP | 2001-204863 | 7/2001 |

OTHER PUBLICATIONS

The Golf Works 1991 Full Line Catalog.

1997 Golf Catalog, "Ti Cu Titan Cavity".

2000 Autumn Golf Clubs & Goods Catalogue, "Guiness World Records MCavity," p. 40.

Yamaha, "Grandis 620", 2001.

*Primary Examiner*—Sebastiano Passaniti
(74) *Attorney, Agent, or Firm*—Sheppard, Mullin, Richter & Hampton LLP

(57) ABSTRACT

A golf club head is disclosed that comprises a body having a striking face and a sole, wherein a recess is formed in the sole. An insert is located within the sole recess, the insert including a core and an intermediate layer that at least partially separates the core from the recess wall. The intermediate layer has a hardness and a modulus of elasticity that are less than that of the core, such that when the golf club head is used to strike a golf ball, the resulting vibrations are dissipated by compression of the intermediate layer and movement of the core with respect to the intermediate layer.

30 Claims, 11 Drawing Sheets

U.S. PATENT DOCUMENTS 4,695,054 A * 9/1987 Tunstall
5,050,879 A * 9/1991 Sun
5,316,305 A 5/1994 McCabe
5,385,348 A * 1/1995 Wargo
5,492,327 A * 2/1996 Biafore
5,518,243 A 5/1996 Redman
5,788,587 A * 8/1998 Tseng
5,833,551 A * 11/1998 Vincent
6,045,456 A 4/2000 Best et al.
6,077,171 A 6/2000 Yoneyama
6,086,485 A * 7/2000 Hamada
6,206,790 B1 3/2001 Kubica et al.
6,409,612 B1 * 6/2002 Evans

* cited by examiner

SECTION D-DA-A

DETAIL B

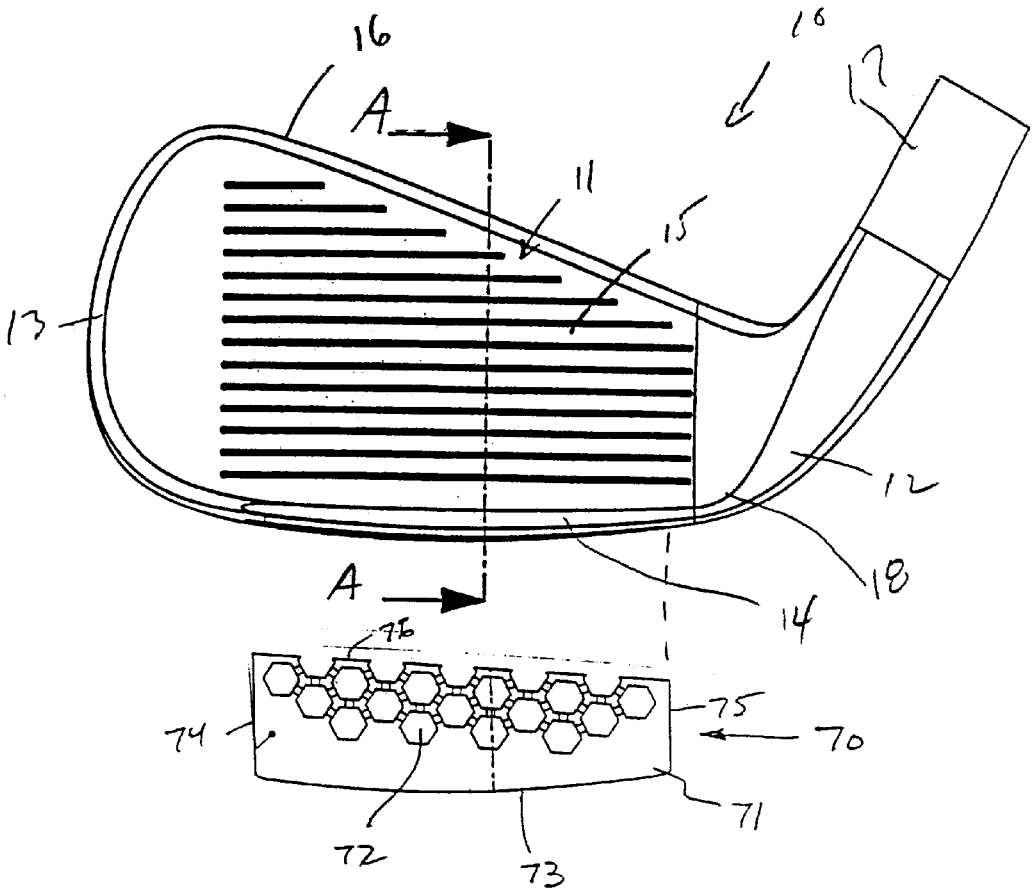
FIG. 7
FIG. 7A
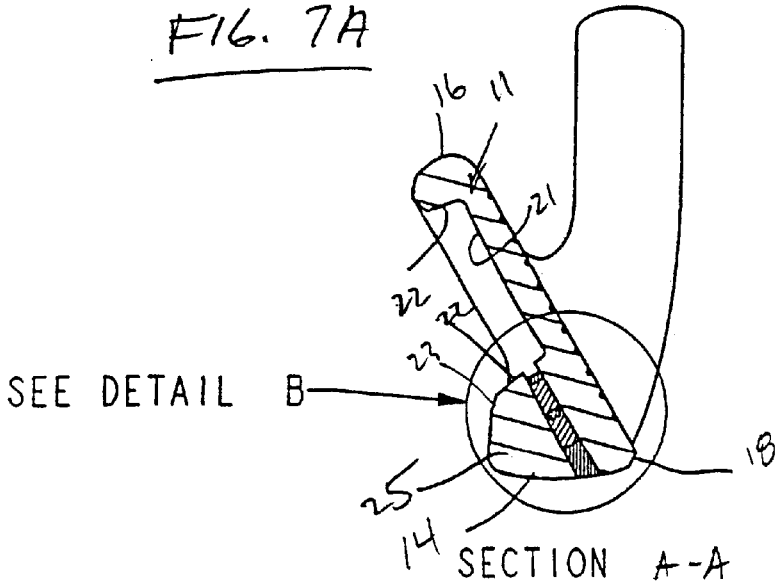

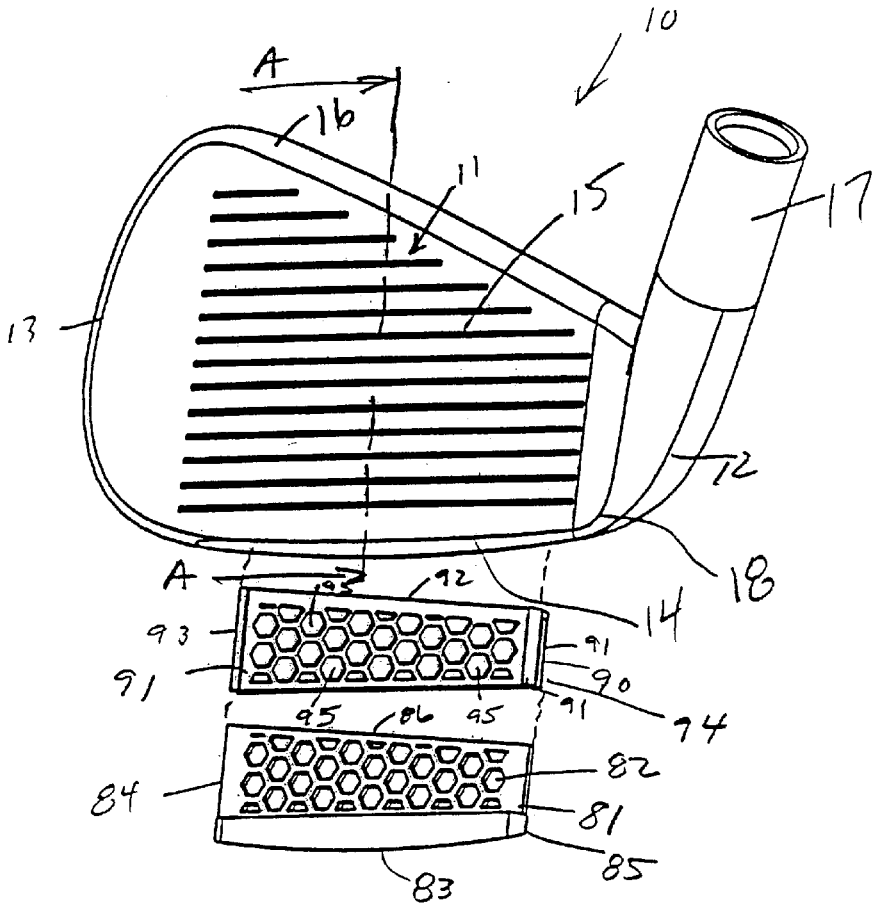
FIG. 8
FIG. 8A
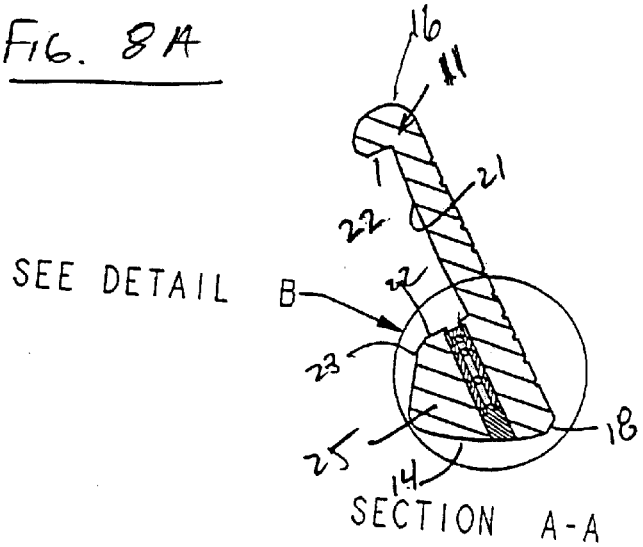

GOLF CLUB HEAD

RELATED APPLICATIONS

This is a divisional of co-pending U.S. patent application No. 09/778,955 filed on Dec. 1, 2000 and priority is claimed under 35 U.S.C. §120.

BACKGROUND OF THE INVENTION

The present invention relates generally to the game of golf and, more particularly, to golf club heads.

Modern golf clubs have typically been classified as either woods, irons or putters. The term "wood" is an historical term that is still commonly used, even for golf clubs that are constructed of steel, titanium, fiberglass and other more exotic materials, to name a few. The term "iron" is also an historical term that is still commonly used, even though those clubs are not typically constructed of iron, but are rather constructed of many of the same materials used to construct "woods."

Many advancements have been achieved, particularly over the past couple of decades, to make it easier to hit longer and straighter shots with woods and irons. In general, golf clubs are now designed to be more forgiving, so that shots that are struck less than perfectly will still have fairly consistent distance and directional control. Moreover, club heads now commonly are constructed of combinations of materials, to attempt to optimize the ball flight desired by a particular type of player.

One particular improvement that relates to irons is the use of perimeter weighting, whereby a disproportionate amount of the total weight of a club head is positioned behind and proximate the perimeter of the club head's striking face, thereby creating a cavity immediately behind the striking face. The cavity is formed by the club face and the weight that is placed around and behind the club face. This type of club is typically referred to a "cavity back" iron. By moving the weight away from the center of gravity (CG) of the club head, the club is made to be more forgiving on off-center hits, resulting in more consistent distance and directional control. Further, perimeter weighting generally increases the moment of inertia about the club's center of gravity, resulting in less twisting due to off-center hits, and more accurate shots.

Another improvement is the use of lighter and stronger materials, which enables club designers to move the CG to an optimal location on a wood or iron. Such a movement can make the club either easier to hook or to fade, if the movement is made either closer to or farther from the hosel. Similarly, if the CG is moved higher or lower with respect to the club face, the golf ball launch conditions can be altered. For instance, lowering the CG generally makes it easier to the get the ball airborne for either an iron or a wood. Conversely, raising the CG promotes a more boring ball flight that generally leaves the club face at a lower launch angle.

Generally, it has been shown that it can be advantageous for players with higher handicaps to use clubs with a lower CG. This is especially true for long irons, such as for example a 3-iron. Club designers have responded to this prospective advantage by lowering the CG of both woods and irons for clubs intended for higher handicap players. The most common way that this has been accomplished for irons is to move as much weight as possible to the area proximate the sole of the club. This results is a concentration of weight proximate the sole. Often, for these types of irons, the transition from the cavity to the weight on the sole is abrupt, compared to traditional irons having a smoother transition. When viewing a cross-section of the lower portion of the club face, a dramatic change in the thickness of the face nearer the sole often is apparent in such sole-weighted club heads.

While it is recognized that the lower CG of the improved clubs can be beneficial, such a lowering can have negative side effects. First, the concentrated mass proximate the sole can increase the stiffness of the club head. This can cause a noticeable change in the club's feel. Feel is a term that is generally used by skilled practitioners to denote a subjective expression of the way a club feels to one's hands when striking a ball, or the way it sounds. Feel is generally perceived as audible or tactile feedback to the golfer. Different sensations due to striking the ball in different locations on the club face may make a club less desirable to a potential user.

Second, the weight concentration proximate the sole can lead to different levels of flex at different points on the club face. The area of the face proximate the thickest portion of the sole is likely to flex less than the area proximate the thinner areas of the striking face. Such a change in flex can adversely affect performance.

Third, the weight concentration can lead to excess vibration, which can adversely affect the feel of the golf club, including the sound made by the club.

It should be appreciated from the foregoing description that there is a need for an improved golf club head that creates a more consistent flex when striking the ball, improves the club's feel, and reduces vibration. The present invention satisfies this need and provides further related advantages.

SUMMARY OF THE INVENTION

The present invention provides a solution to counteract the negative side affects described above, by allowing club designers to design a club with an optimal center of gravity, while at the same time lowering the stiffness proximate the sole, creating more consistent flex while striking the ball, improving the feel of the club, and reducing vibration.

Generally, the present invention can be practiced using a variety of common club head shapes that are known in the art. Preferably, the club head comprises a unitary body that has a striking face and a sole. A recess is preferably formed in the sole that is adapted for receiving an insert. The preferred insert comprises a core and an intermediate layer. The intermediate layer generally is formed from a material that has a hardness and a modulus of elasticity that are lower than that of the core. The intermediate layer is generally disposed so that it partially encapsulates the core or fills interstices within the core. Three embodiments of the invention are shown and described below.

According to the first preferred embodiment of the invention, a set of cells are embedded proximate a sole portion of a preferred club head. The preferred club head comprises a body that has perimeter weighting and a cavity back. The cavity back may be either open or closed, such as for example in a hollow club head. The body is substantially similar to many cavity back clubs that are known in the art. The perimeter weighting of the preferred body forms a sole bar proximate the sole. The sole bar has an elongated slot that is formed or is cut therethrough, the slot extending between the toe and the heel of the body. Proximate the slot are a plurality of a apertures that are formed so as to receive a corresponding plurality of cells. The number of apertures may vary.

The cells each comprise a pin that is preferably encased in an elastomeric sleeve. The preferred cells, the apertures, and the preferred pins and sleeves are generally aligned so that their longitudinal axes are parallel with the striking face of the golf club head. Further, the longitudinal axes are preferably aligned generally parallel with the loft angle of a particular club.

During manufacture, the preferred cells are preferably inserted through the elongated slot, and sealed from the sole and held in place by a plug that is inserted into the slot so as to be flush with the sole upon completion of manufacture. The plug is held in place by conventional means known in the art, some of which are described below in the Detailed Description.

According to a second embodiment of the invention, a cartridge is used to provide the advantages described above. The preferred cartridge comprises a metal substrate having a plurality of interstices spaced therein. The interstices are preferably filled with a polymeric material.

According to a third embodiment of the invention, a cartridge is used to provide the advantages described above. The preferred cartridge comprises a metal substrate having a plurality of interstices spaced therein. A polymeric sleeve is preferably folded over a portion of the metal substrate. The preferred polymeric sleeve has nubs on an outer surface where contact is made with the club head body.

It is an object of the present invention to provide a golf club head that reduces club head stiffness.

It is a further object of the present invention to provide a golf club head that results in a more uniform face deflection in the hitting area.

It is a further object of the present invention to provide a golf club head that improves the feel of a golf club.

It is a further object of the present invention to provide a golf club head that absorbs energy.

It is a further object of the present invention to provide a golf club head that improves the weight distribution of a golf club.

BRIEF DESCRIPTION OF THE DRAWINGS

FIG. 7 is a front view of a second preferred embodiment of a golf club head in accordance with the invention, showing the club head's striking face. The club head body shown in FIG. 7 is substantially similar to the club head body shown in FIGS. 1–6, except for the dimensions of the slot formed therein.

FIG. 7A is a cross-sectional view of the golf club head of FIG. 7, viewed along line A—A, depicting the slot in the sole formed therein, and further depicting a side view of the preferred cavity.

FIG. 8 is a front view of a third preferred embodiment of a golf club head in accordance with the invention, showing the club head's striking face. The club head body shown in FIG. 8 is substantially similar to the club head body shown in FIGS. 1–6, except for the dimensions of the slot formed therein.

FIG. 8A is a cross-sectional view of the golf club head of FIG. 8, viewed along line A—A, depicting the slot in the sole formed therein, and further depicting a side view of the preferred cavity.

DETAILED DESCRIPTION OF THE PREFERRED EMBODIMENTS

Figure 1:
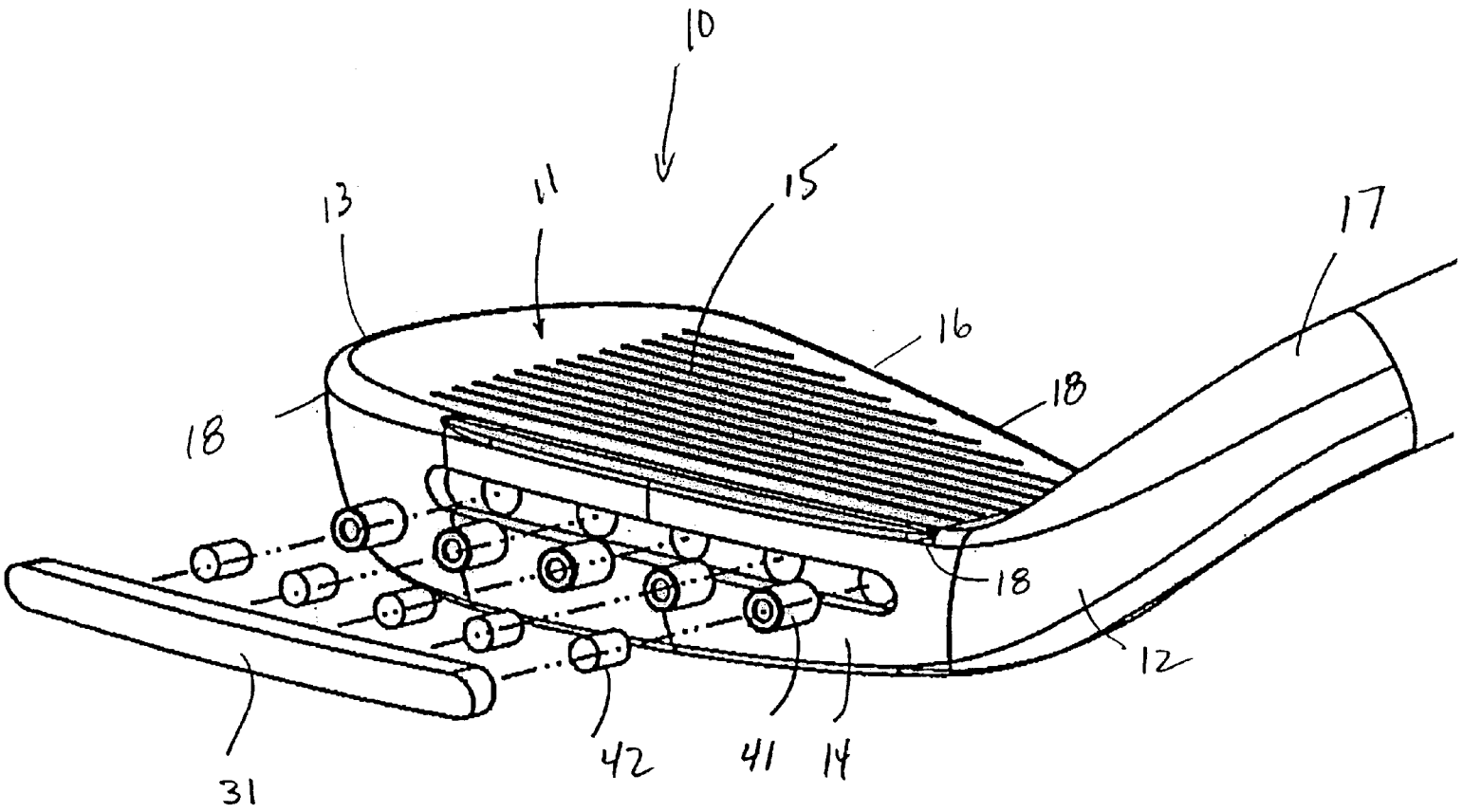
FIG. 1 is an exploded view of a golf club head of the preferred embodiment, having a sole, a striking face, a heel and an insert assembly.
Figure 5:
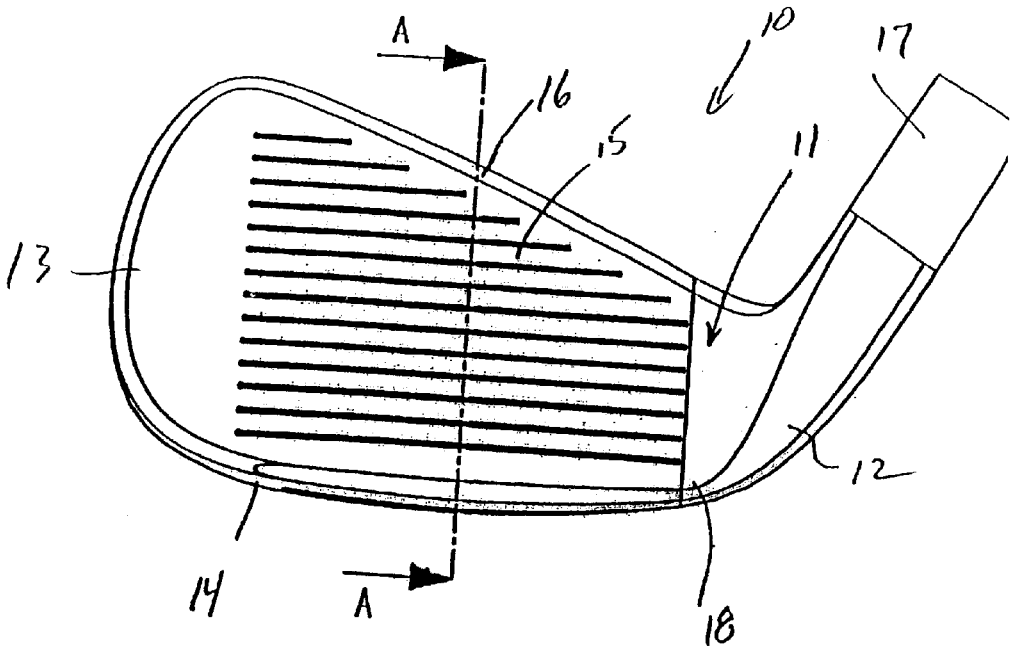
FIG. 5 is a front view of the golf club head of FIG. 1, showing its striking face.

With reference now to the exemplary drawings, and particularly to FIGS. 1 and 5, there is shown a preferred golf club head 10 in accordance with the present invention. The club head 10 is similar to many cavity back club heads that are known in the art. The club head 10 includes a body 11 having a front striking face 15 that is bounded by a striking face perimeter 18. The perimeter is proximate a heel 12, a toe 13, a sole 14, a hosel 17 and a top line 16. The striking face 15 is the portion of the body 11 that is used to make contact with a golf ball (not shown). The hosel 17 allows the club head 10 to be connected to a shaft and a grip (not shown), to form a complete golf club, as is known in the art.

Figure 2:
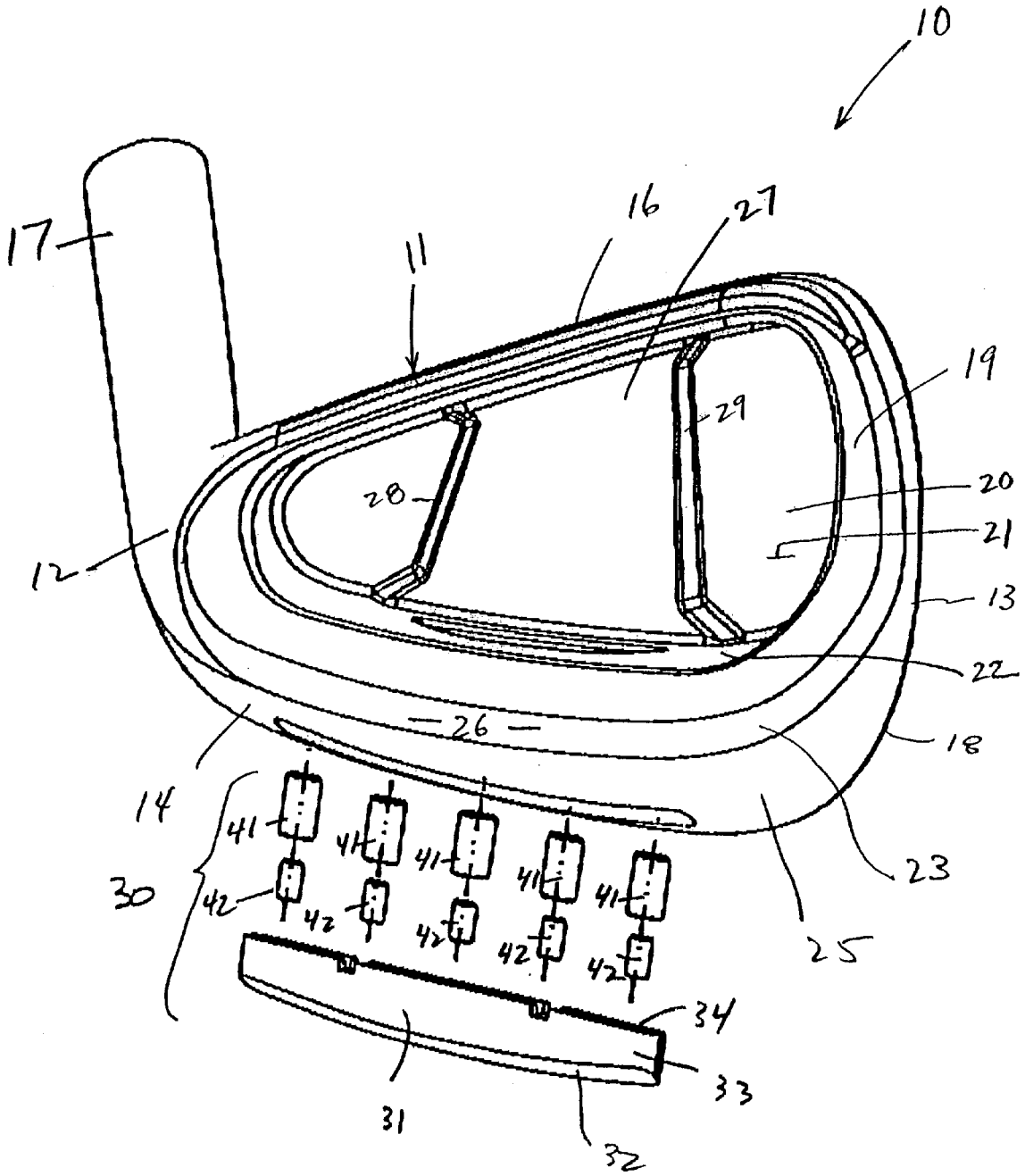
FIG. 2 is an exploded view of a rear cavity and an insert assembly that are part of the golf club head of FIG. 1.

The body 11 also has a rear cavity 20 that is bounded by a cavity perimeter 19, as shown in FIG. 2. As is typical of many cavity back irons, the preferred body 11 has a cavity wall 21 that forms the back side of the striking face 15 and that is substantially parallel to the striking face 15. The cavity perimeter 19 is proximate to, and surrounds, the cavity wall 21. The cavity perimeter 19 has a cavity rim 22 that extends substantially rearwardly from the cavity wall 21 and the striking face 15, as shown is FIG. 5A. The cavity rim 22 surrounds the cavity 20, as shown in FIG. 2. Although a cavity back iron is shown and described, the invention described herein may apply to other irons having a sole bar, such as hollow-headed irons.

The construction of the body 11 is such that a substantial amount of the weight is concentrated proximate the cavity perimeter 19, hence a common description is "perimeter weighted," or "cavity back." The preferred body 11 has perimeter weighting 25 that comprises a mass of material that extends rearwardly of the striking face perimeter 18. The preferred perimeter weighting 25 may extend proximate the entire perimeter 18, or a portion thereof, dependent on desired weight distribution characteristics. The perimeter weighting 25 includes a sole bar 26, which is a concentrated mass that is located proximate the sole 14 so as to provide the desired weight distribution characteristics.

Figure 5A:
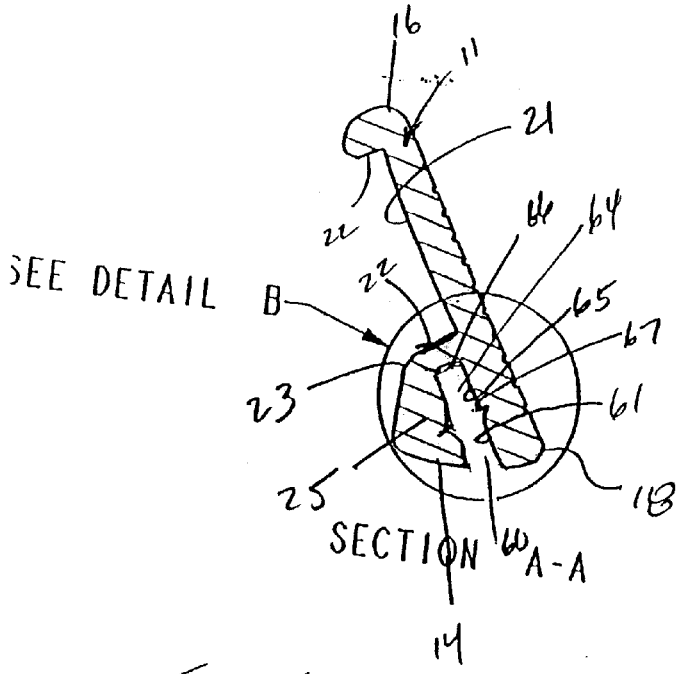
FIG. 5A is a cross-sectional view of the golf club head of FIG. 5, viewed along line A—A, depicting the slot in the sole and one of a plurality of preferred apertures formed therein, and further depicting a side view of the preferred cavity.
Figure 5B:
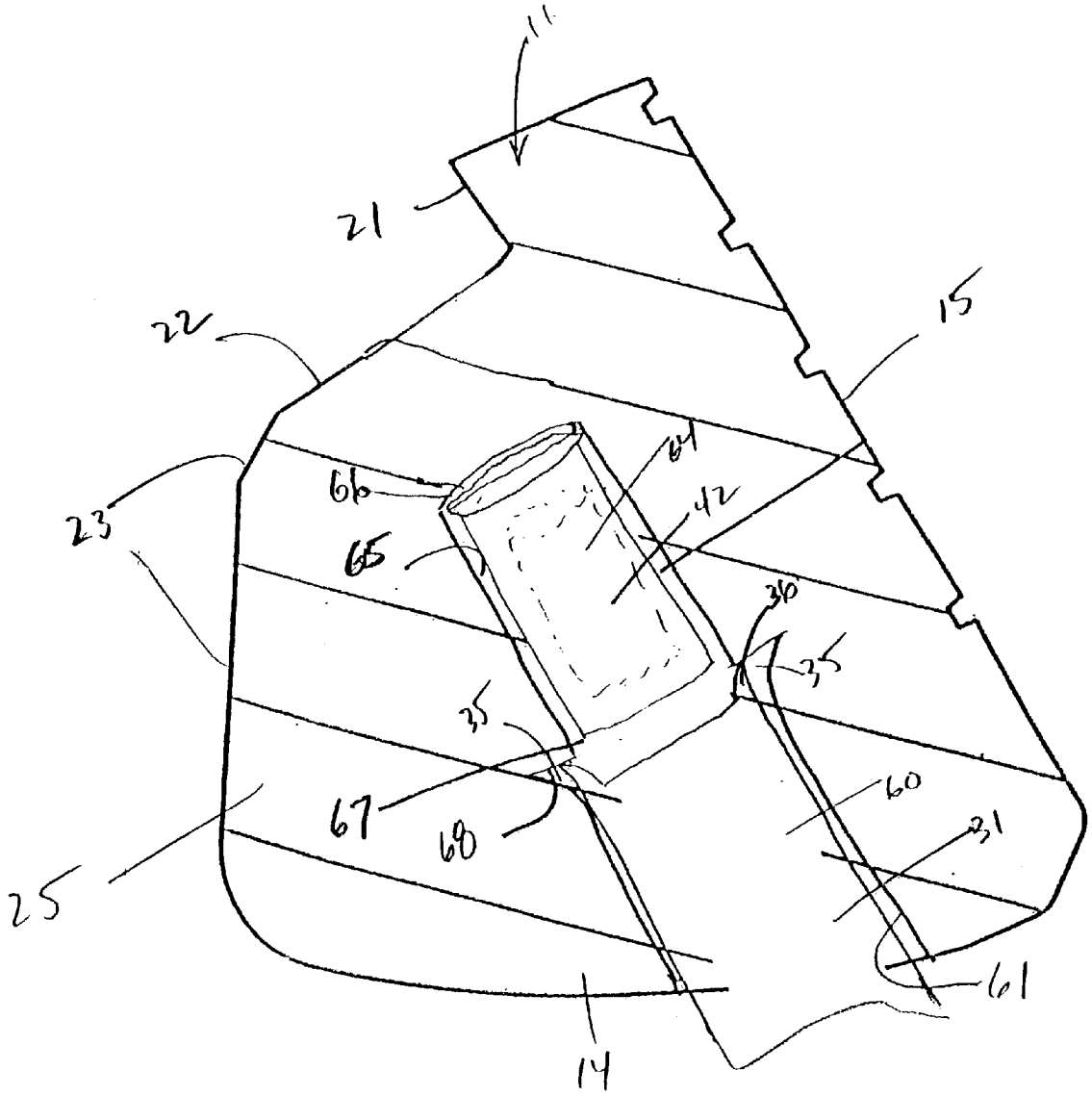
FIG. 5B is an enlarged view of the circled portion of FIG. 5A, depicting the nearly assembled club head with the insert assembly in place and a plug that is ready to be ground flush with the sole.

As is known in the art, the perimeter weighting 25 may take various shapes as it wraps from the striking face 15 to the cavity wall 21. FIGS. 2, 5A and 5B show the preferred perimeter weighting 25 configuration, with a cavity transition 23 between the cavity rim 22 and the sole 14. The transition 23 may be in the form of a radius or a series of degradations.

The body 11 has a raised cavity center weight 27 that protrudes rearwardly from the cavity wall 21 and that is bordered by the cavity perimeter 19 on two sides and by cavity step downs 28, 29. Alternatively, the cavity wall 21 could be substantially flat or have other shapes to create different performance characteristics and different weight distribution.

The body 11 preferably is formed of a cast stainless steel. This material is preferred because of its ductility, its relative softness that contributes to good feel, its resistance to corrosion, its strength, and its ability to be investment cast. A variety of stainless steel products and other similar known materials alternatively could be used.

Figure 4A:
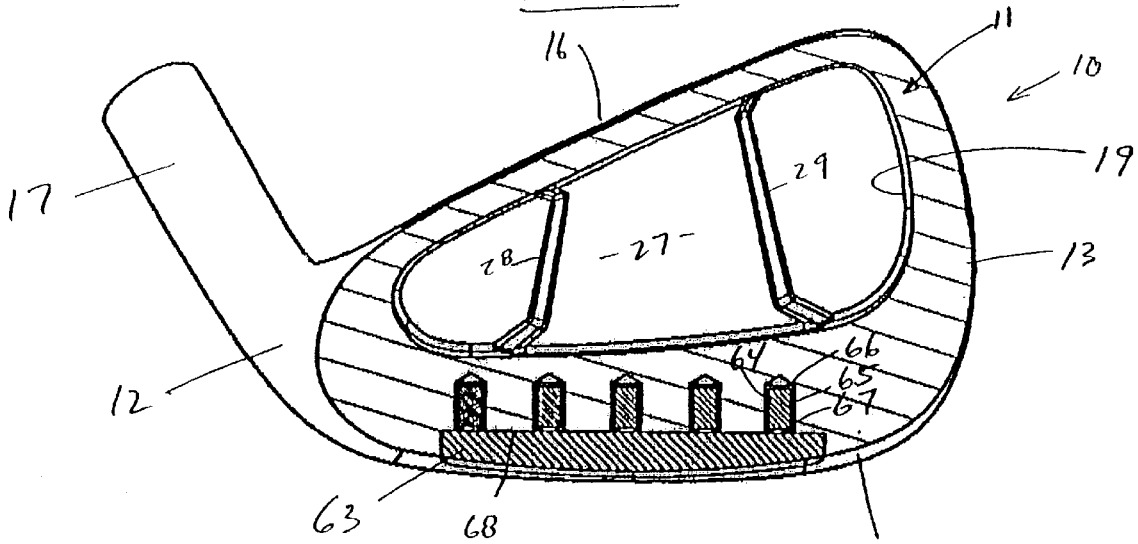
FIG. 4A is a cross-sectional view of the golf club head of FIG. 4, viewed along line A—A, showing the preferred insert assembly and the rear cavity.
Figure 4:
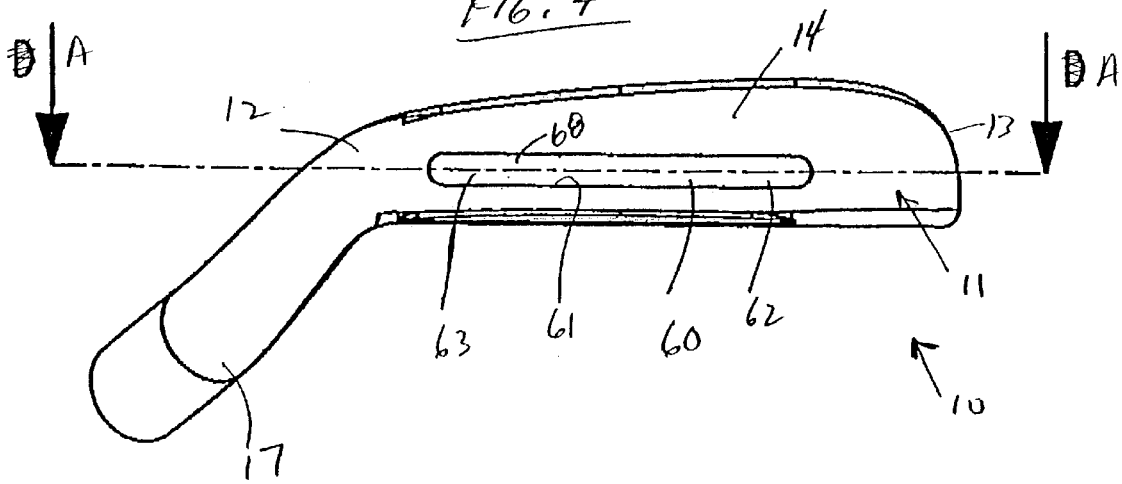
FIG. 4 is a bottom view of the golf club head of FIG. 1, showing the sole and a slot formed within the sole.

As shown in FIGS. 1, 2 and 4, the body 11 has a slot 60 formed proximate the sole 14. The slot 60 preferably extends longitudinally between the heel 12 and the toe 13. The slot 60 is formed within the sole bar 26, and it is defined by a slot wall 61 running on all sides of the slot 60 and a shoulder 68. The slot 60 has a toe end 62 and a heel end 63, as shown in FIG. 4.

Preferably, a plurality of cylindrical apertures 64 are formed proximate the slot 60, as shown in FIGS. 4A and 5A. The apertures 64 each have a proximal end 67 and a distal end 66. The proximal end 67 is located proximate the slot shoulder 68 and the distal end 66 is located nearer to the cavity rim 22. Preferably, the distal end 66 of each aperture does not enter the cavity 20. Subject to manufacturing constraints, a further embodiment would have apertures extending into the cavity 20, entering the cavity proximate the cavity rim 21. The apertures 64 are preferably cylindrical in shape, and form conical sections at their distal ends 66, as a result of the use of drill bits in manufacture. Other similar shapes could be used. Each aperture 64 is defined by an aperture wall 65.

Preferably, the axis of each aperture 64 is parallel to the striking face 15 and substantially perpendicular to a plane defined by the sole 14.

The slot 60 and the apertures 64 may be formed by means known in the art. In the preferred embodiment, a slot 60 and a plurality of apertures 64 are cast into the body 11 and then machined and drilled to appropriate tolerances. The slot 60 and apertures 64 are sized and configured to receive an insert assembly 30, as shown in FIGS. 1 and 2. The preferred insert assembly 30 comprises a plug 31 and a plurality of cells 40 that are sized and configured to fit within the slot 60 and the apertures 64.

Figure 3:
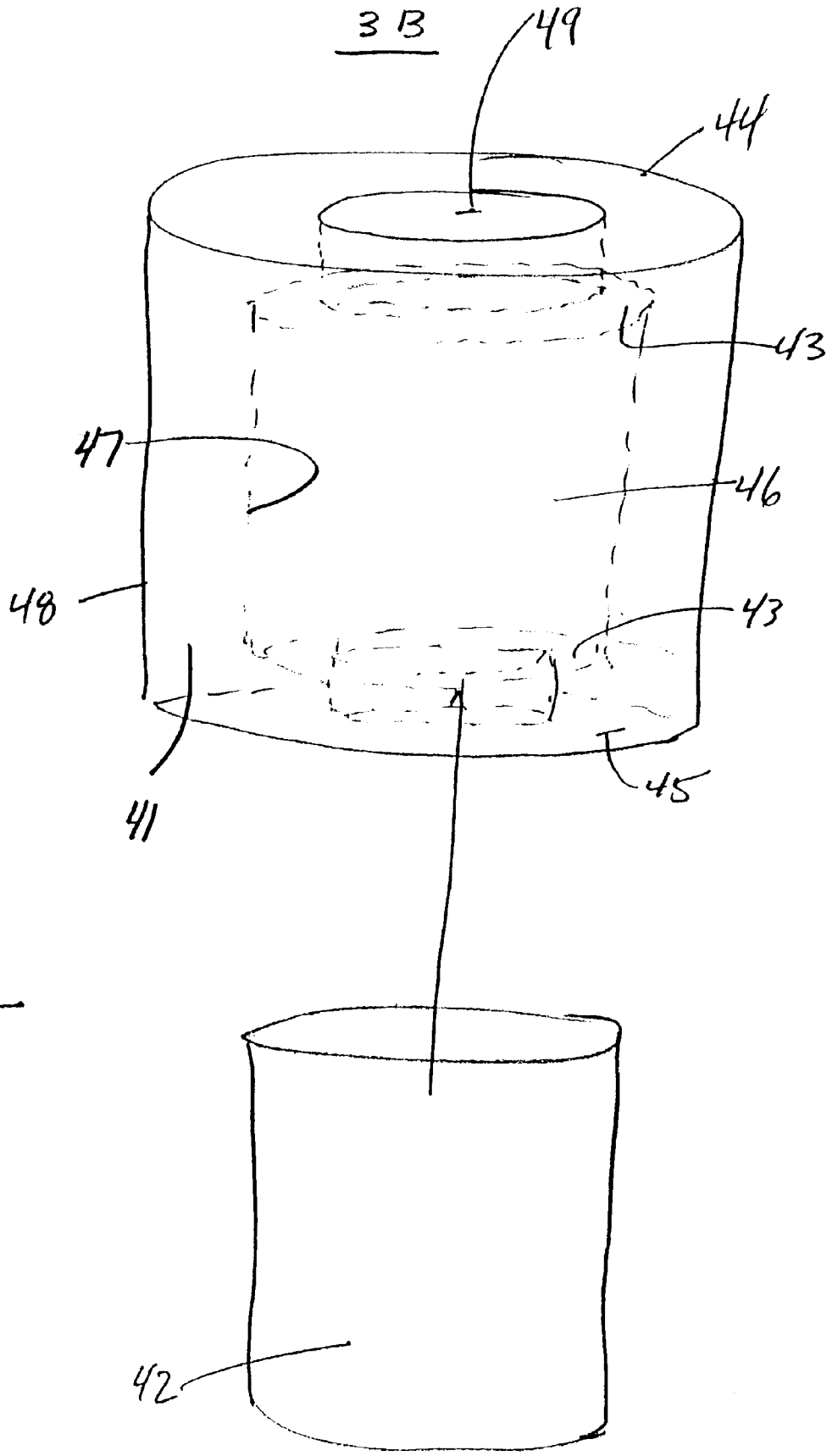
FIG. 3 is an exploded view of a cell that can be used with the golf club head of FIG. 1.

A preferred cell 40 is shown in FIG. 3. Each cell 40 may include a sleeve 41 and a pin 42, as separate units. When placed in an aperture, each sleeve 41 partially or totally encases a corresponding pin 42. The sleeve 41 may form an air pocket 49 at one or both ends. The sleeve 41 has a top 44, a bottom 45, an inner wall 47, an outer wall 48, and a shoulder 43. The interface between the outer wall 48 and the bottom 45 may be flared outwardly to assist in manufacturing. The shoulder 43 and inner wall 47 define a void 46 where the pin 42 may be inserted upon final assembly. The dimensions of the cell 40, including the pin 42 and the sleeve 41, can vary for different irons within a set of clubs, due to the different dimensions of the respective soles and sole bars for those different irons.

The preferred sleeve 41 may be constructed using an elastomer, including thermoplastic materials such as urethane. The sleeve may be formed of a variety of materials known in the art, so long as the chosen material has a hardness and modulus of elasticity that are lower than that of the pin 42, and so long as it is easy to manufacture. For example, the preferred material, urethane, is sufficiently elastic and can be injection molded, so that it is readily manufacturable.

The preferred pin 42 may be constructed of stainless steel or a variety of similar materials that are known in the art, so long as the chosen material is sufficiently dense and has a relatively high modulus of elasticity. Exemplary materials include steel, copper, bronze, tungsten and nickel, to name a few.

The assembled cell 40 is inserted into a corresponding aperture 64 by means known in the art. When fully inserted, the sleeve 41 generally prevents the pin 42 from contacting the body 11, so that there is minimal or no contact between the pin 42 and the body 11. The preferred body 11 has five apertures 64 and five cells 40, although that number may be varied based on the damping, stiffness, feel and weight distribution characteristics that are desired.

The preferred cells 40 are held in place in the apertures by the plug 31. The preferred plug 31 has a substantially flat inner wall 34, a circumferential side wall 33 that extends around the plug 31, and a generally curved sole portion 32. When assembled, the inner wall 34 seats proximate the shoulder 68, and it frictionally holds the cells 40 in place. The plug side wall 33 when assembled is proximate the slot wall 61, and the plug sole 32 is proximate the sole 14.

The plug 31 preferably includes a set of ridges 36, one on each side, as particularly shown in FIG. 5B. The slot 60 preferably has a recess 35 that runs longitudinally between the toe end 62 and heel end 63. Upon insertion into the slot 60, pressure is applied to force the plug 31 to seat proximate the shoulder 68. Upon application of appropriate pressure, the ridges 36 are forced to deform so as to seat within the recesses 35, thereby frictionally holding the plug 31 in place. As shown in FIG. 5B, the pin 42 is preferably separated from contact with the plug 31 by the sleeve 41. The plug 31 protects the cells 40 from interaction with the ground. The plug 31 is preferably made of bronze, although other, similar materials also could be used. The plug 31 should be made of an appropriate material based on its hardness, durability and ductility, as appreciated by those skilled in the art. Bronze, for instance, allows a sufficient level of ductility to allow an appropriate level of flexing.

Figure 6:
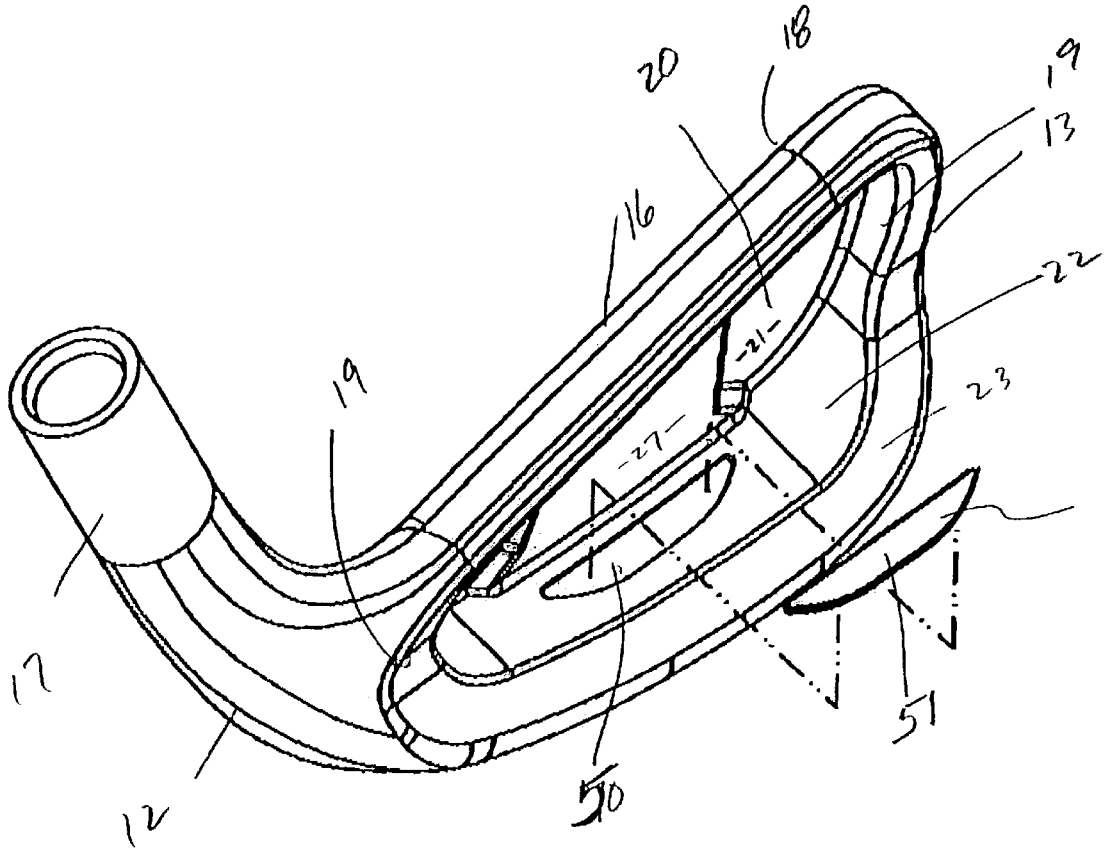
FIG. 6 is a rear view of the cavity of the golf club head of FIG. 1, showing an exploded view of a preferred badge that is not yet attached to the cavity.

The final assembly process is to grind or otherwise remove the excess material from the plug 31, so that the plug 31 lies flush with the sole 14 of the body 11. As shown in FIG. 6, a badge 51 may also be used, which is preferably seated on the cavity rim 22 as shown at location 50.

The preferred club head 10 has improved feel, improved vibration damping characteristics, and reduced stiffness, as compared to prior clubs in the art. Further, the preferred club head 10 may have advantageous weight distribution properties. The apertures 64 formed within the sole bar 26 reduce the stiffness of the lower part of the club 10 due to the removal of material and the elimination of a singular mass of material. The removal of the material, by itself, can lead to improved feel.

The use and placement of the cells 40 can also have a dramatic effect on the ability of the preferred club head 10 to absorb shock and to improve the feel. The cells 40 work in the following manner. When a golf ball (not shown) is struck by the club head, the collision generally causes vibration in the head. Low frequency vibrations can be felt with the hands, and can be unpleasant. High frequency vibrations can be audible, and can lead to an unpleasant and inconsistent sound.

With reference now to FIG. 5B, if the depicted club head 10 were moving to the right to contact a golf ball (not shown), the club head's velocity would be slowed at impact. However, because the pins 42 are not fixedly attached to the body 11, the momentum of the pins 42 would continue to drive them forwardly. The sleeves 41 would compress and cushion the deflection of the pins 42, thereby keeping the pins separated from the body while at the same time absorbing some of the energy imparted on the club head 10 due to the collision with the ball. Two major effects are caused by the configuration of the cells 40. First, there are viscous effects. Due to the material properties of the sleeve 41, the sleeves are compressed and then released as the pins 42 rebound off of the sleeves 41. Second, there are frictional effects. After impact, upon the excitation of vibration modes and multiple deflections, the pins 42 are jostled around within the sleeves 41, rubbing, sliding and shaking in the head like mini pistons. This contact between the sleeves 41 and the pins 42 caused by micro-motions also dissipates energy in the form of heat due to friction. The frictional effects may be greater than the viscous effects. With the preferred five cells 40 working simultaneously, energy is being removed by multiple sources.

In a similar fashion, the plug 31 can also dissipate or absorb vibration. Because the plug 31 preferably is constructed of a material that is different than the body 11, those different materials can result in a further dissipation of energy.

FIG. 7 depicts a second embodiment of a golf club head 10 in accordance with the present invention. In this embodiment, a cartridge 70 is used with a club head body 11 that is substantially similar to the body shown in FIGS. 1–6. In this second embodiment, the cartridge 70 functions to provide similar benefits to those described for the first embodiment. This includes viscous effects and frictional effects.

The second embodiment preferably uses a substrate 71 that is inserted into a slot 77 having sides 78. The slot 77 is preferably formed within the club head body, proximate the sole bar 26. The slot 77 may vary in thickness, length and distance from the face, so as to allow various performance changes to the club head. Further, the slot 77 may extend from the sole 14 to the cavity rim 22, or some portion thereof.

The substrate 71 preferably is constructed of bronze, although other conventional materials alternatively can be used, including metals such as aluminum or tungsten, or non-metals such as carbon fiber. The substrate 71 generally should be sufficiently durable and ductile. The preferred substrate 71 has a plurality of interstices 72 formed therein, which may be filled with a polymer, such as polyurethane, or other similar materials having a hardness and a modulus of elasticity that are lower than those of the body 11, and that are easy to manufacture. For example, the preferred material, urethane, is sufficiently elastic and can be injection molded, so that it is readily manufacturable.

The cartridge 70 has a toe end 74, a heel end 75, a top side 76 and a cartridge sole 73. When assembled, the cartridge 70 is inserted into the slot 77 and is attached using means known in the art. The toe end 74 of the cartridge 70 is positioned proximate the toe 13 of the body, the heel end 75 is positioned proximate the heel 12 of the body 11, and the cartridge sole 73 is positioned proximate the sole 14 of the body 11. The top side 76 of the cartridge is positioned proximate the cavity 20. If the slot 77 extends completely through to the cavity 20, the cartridge 70 may also extend to the cavity 20, or a portion thereof.

Figure 7B:
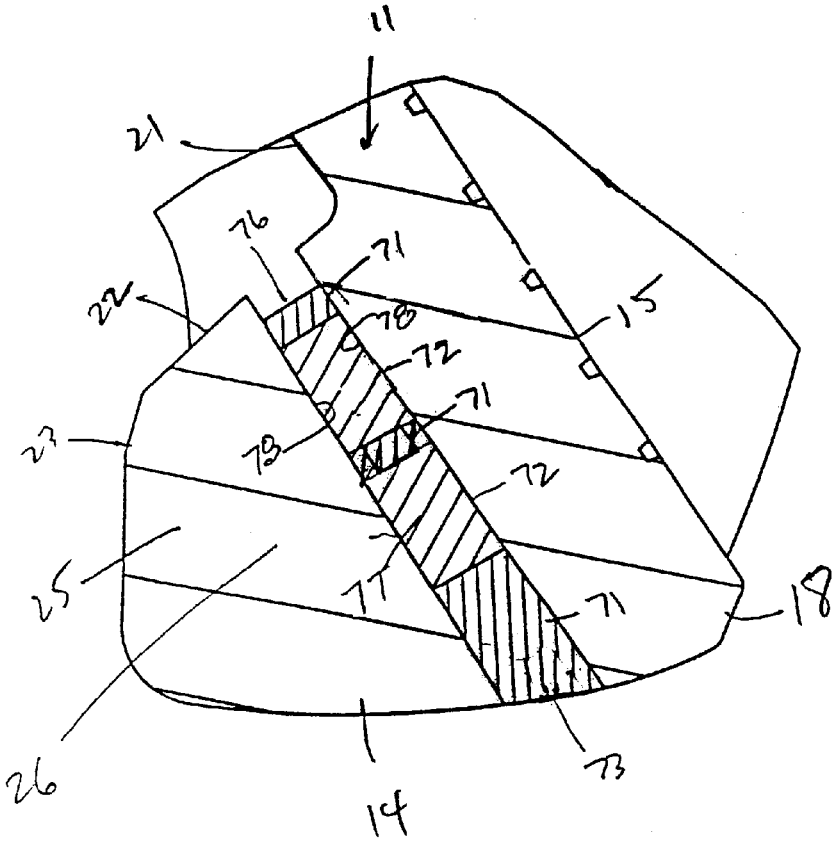
FIG. 7B is an enlarged view of the circled portion of FIG. 7A, depicting the assembled club head with the cartridge in place.

The second preferred embodiment of FIG. 7 provides many of the benefits of the first preferred embodiment of FIGS. 1–6. In a manner similar to the preferred embodiment, the cartridge shown in FIGS. 7, 7A and 7B can provide an improved club head feel, improved vibration damping characteristics, and reduced stiffness as compared to prior clubs in the art. The slot 77 formed within the sole bar 26 may reduce the stiffness of the lower part of the club 10 due to the removal of material and the elimination of a singular mass of material.

The use of the cartridge 70 can also dramatically affect the ability of the club head 10 to absorb shock and to improve the feel. The substrate 71, combined with the interstices 72 filled with a polymer, can help reduce vibration, due to the absorption of energy by the polymer, and due to the geometry of the slot 77, which impedes vibration.

Figure 8B:
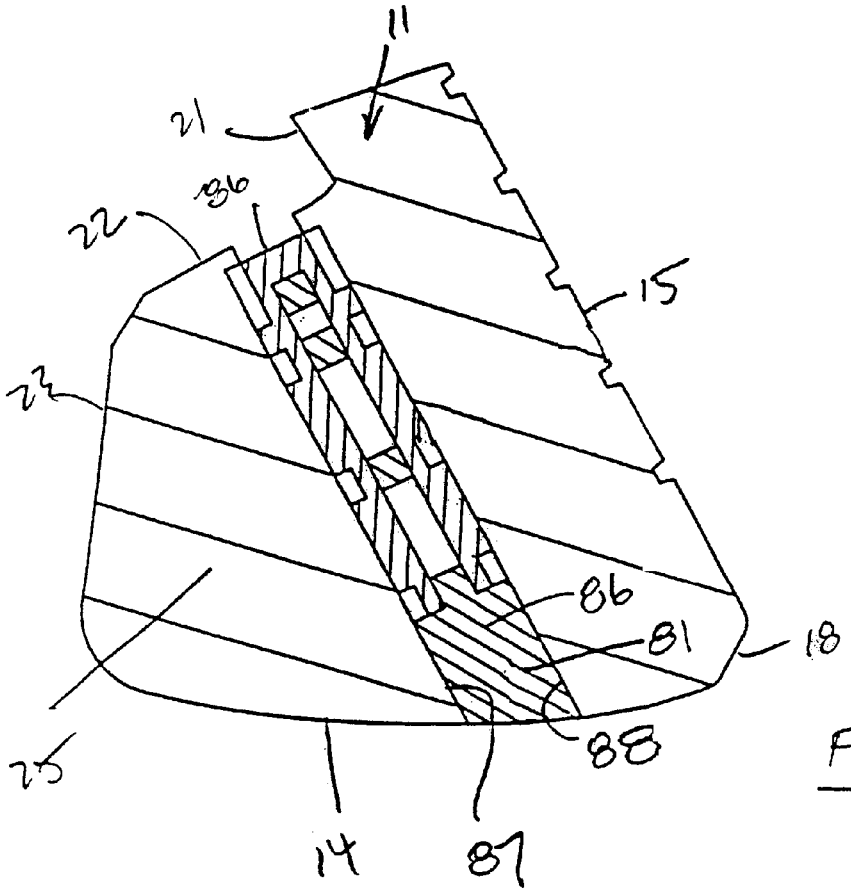
FIG. 8B is an enlarged view of the circled portion of FIG. 8A, depicting the assembled club head with the cartridge in place.

FIG. 8 depicts a third preferred embodiment of a golf club head 10 in accordance with the present invention. In this embodiment, a cartridge 80 is used with a club head body 11 that is substantially similar to the body shown in FIGS. 1–6 and the body shown in FIGS. 7, 7A and 7B. In this third embodiment, the cartridge 80 functions to provide similar benefits to those described for the first and second embodiments.

The third preferred embodiment preferably uses a substrate 81 that is inserted into a slot 87 having sides 88. The slot 87 preferably is formed within the club head body, proximate the sole bar 26, similar to the second embodiment shown in FIG. 7. The slot 87 may vary in thickness, length and distance from the face, so as to allow various performance changes to the club head. Further, the slot 87 may extend from the sole 14 to the cavity rim 22, or some portion thereof.

The substrate 81 preferably is constructed of bronze, although various metals and other similar materials may alternatively be used, as are known in the art, similar to those mentioned for the second embodiment. The preferred substrate 81 may have a plurality of interstices 82 formed therein, which function to reduce the stiffness of the substrate 81.

Like the second preferred embodiment, this cartridge 80 has a toe end 84, a heel end 85, a top side 86 and a cartridge sole 83. When assembled, the cartridge 80 is inserted into the slot 87 and attached using means known in the art. The toe end 84 of the cartridge is positioned proximate the toe 13 of the body, the heel end 85 is positioned proximate the heel 12 of the body 11, and the cartridge sole 83 is positioned proximate the sole 14 of the body 11. The top side 86 of the cartridge is positioned proximate the cavity 20. If the slot 87 extends completely through to the cavity 20, the cartridge 80 may also extend to the cavity 20, or a portion thereof.

The third embodiment may have a sleeve 90 that is positioned proximate the cartridge 80. The sleeve 90 is formed so that it has two planar sides 91 and a sleeve top 92. When assembled, the sleeve 90 folds over the cartridge 80. The sleeve top 92 mounts proximate the top side 86 of the cartridge 80, and the sides 91 drape over the sides of the substrate 81. The preferred sleeve 90 may have plurality of nubs 95 formed therein, which can provide improved performance characteristics. Preferably, the nubs 95 are positioned on the surface of the sleeve 90 that lies proximate the body 11. The nubs 95 reduce the surface area of contact between the cartridge 80 and body 11. During ball contact, energy is more efficiently transferred to, and absorbed by, the preferred polymer sleeve 90.

The third preferred embodiment provides many of the benefits of the other embodiments. In a manner similar to the other embodiments, the cartridge 80 shown in FIGS. 8, 8A and 8B can improve club head feel, improve vibration damping characteristics, and reduce stiffness as compared to prior clubs in the art. The slot 87 formed within the sole bar 26 reduces the stiffness of the lower part of the club 10 due to the removal of material and elimination of a singular mass of material.

The use of the cartridge 80 also can dramatically affect the ability of the club head 10 to absorb shock and to improve the feel. The substrate 81, combined with the interstices 82, which may be filled with a polymer or left as a void, can help reduce vibration, due to the absorption of energy by the polymer, and due to the geometry of the slot 87, which impedes vibration. The use of the sleeve 90 provides an additional layer of material to absorb vibration.

Although the invention has been disclosed in detail with reference only to the preferred embodiments, those skilled in the art will appreciate that golf club heads can be made without departing from the scope of the invention. Accordingly, the invention is defined only by the claims set forth below.

We claim:

1. A golf club head comprising:

a heel;

a toe;

a striking face;

a rear cavity;

a sole;

a sole bar proximate the sole;

a slot formed proximate the sole bar, the slot extending longitudinally between the toe and the heel, the slot extending from the sole at least partly through the sole bar to the rear cavity; and a cartridge disposed within the slot, the cartridge comprising a substrate having interstices, said interstices filled with a material that is softer than the substrate.

2. The golf club head of claim 1, wherein said substrate is formed of metal.

3. The golf club head of claim 1, wherein said substrate is formed of aluminum.

4. The golf club head of claim 1, wherein said substrate is formed of bronze.

5. The golf club head of claim 1, wherein the interstices of said substrate are filled with an elastomeric material.

6. The golf club head of claim 1, wherein the interstices of said substrate are filled with urethane.

7. The golf club head of claim 1, wherein the slot has slot sides, and the material filling the interstices of said substrate also is disposed between the substrate and the slot sides.

8. The golf club head of claim 1, wherein the slot has slot sides, and the material filling the interstices of said substrate also is positioned between the substrate and the slot side that is proximate the striking face.

9. The golf club head of claim 1, wherein said slot extends from the sole to the rear cavity.

10. A golf club head comprising:

a heel;

a toe;

a striking face;

a rear cavity;

a sole;

a sole bar proximate the sole;

a slot formed proximate the sole bar, the slot extending longitudinally between the toe and the heel, the slot extending from the sole at least partly through the sole bar to the rear cavity;

a cartridge disposed within the slot, the cartridge comprising a substrate that extends longitudinally between the toe and the heel; and a sleeve that covers at least a portion of the substrate.

11. The golf club head of claim 10, wherein said sleeve is formed of a material that is softer than that of the substrate.

12. The golf club head of claim 10, wherein said sleeve is formed of an elastomer.

13. The golf club head of claim 10, wherein said sleeve covers a substantial portion of said substrate.

14. The golf club head of claim 10, wherein said substrate is formed of metal.

15. The golf club head of claim 10, wherein said substrate has a plurality of interstices.

16. The golf club head of claim 10, wherein the sleeve is formed of urethane.

17. The golf club head of claim 10, wherein the sleeve has nubs formed thereon.

18. The golf club head of claim 10, wherein the slot has slot sides, the sleeve has nubs, and the nubs are positioned proximate the slot sides.

19. The golf club head of claim 10, wherein the slot has slot sides, the sleeve has nubs, and the nubs are positioned proximate the slot sides and proximate the substrate.

20. The golf club head of claim 10, wherein said slot extends from the sole to the rear cavity.

21. The golf club head of claim 10, wherein said substrate is rigid.

22. An iron-type golf club head comprising:

a body having a striking face, a rear cavity, and a sole, wherein a recess is formed in the sole, the recess having a recess wall and including an elongated slot formed in the sole, extending from a heel of the club head to a toe of the club head;

an insert located within the sole recess, the insert including a core and an intermediate layer that at least partially separates the core from the recess wall;

the core of the insert comprises a substrate having interstices; and the intermediate layer of the insert comprises a separate material that is disposed within the interstices of the substrate and that is located at least partially between the substrate and the recess wall; and wherein the intermediate layer has a hardness and a modulus of elasticity that are less than that of the core, such that when the golf club head is used to strike a golf ball, the resulting vibrations are dissipated by compression of the intermediate layer and movement of the core with respect to the intermediate layer.

23. An iron-type golf club head comprising:

a body having a striking face, a rear cavity, and a sole, wherein a recess is formed in the sole, the recess having a recess wall; and the sole recess includes an elongated slot formed in the sole, extending from a heel of the club head to a toe of the club head;

an insert located within the sole recess, the insert including a core and an intermediate layer that at least partially separates the core from the recess wall;

the core of the insert comprises an elongated substrate; and the intermediate layer of the insert comprises a sleeve that at least partially surrounds the substrate, the sleeve being disposed between the substrate and the recess wall; and wherein the intermediate layer has a hardness and a modulus of elasticity that are less than that of the core, such that when the golf club head is used to strike a golf ball, the resulting vibrations are dissipated by compression of the intermediate layer and movement of the core with respect to the intermediate layer.

24. A golf club head comprising:

a heel;

a toe;

a striking face;

a sole;

a sole bar proximate the sole;

a slot formed proximate the sole bar, the slot extending longitudinally between the toe and the heel, and the slot having slot sides; and a cartridge disposed within the slot, the cartridge comprising a substrate having interstices, said interstices filled with a material that is softer than the substrate, said material tilling the interstices also disposed between the substrate and the slot side that is proximate the striking face.

25. The golf club head of claim 24, wherein the material filling the interstices of said substrate is disposed between the substrate and both of the slot sides.

26. A golf club head comprising:

a heel;

a toe;

a striking face;

a sole;

a sole bar proximate the sole;

a slot formed proximate the sole bar, the slot extending longitudinally between the toe and the heel;

a cartridge disposed within the slot, the cartridge comprising a substrate that extends longitudinally between the toe and the heel; and a sleeve that covers at least a portion of the substrate, wherein nubs are formed on said sleeve.

27. The golf club head of claim 26, wherein the slot has slot sides, and the nubs are positioned proximate the slot sides.

28. The golf club head of claim 26, wherein the slot has slot sides, and the nubs are positioned proximate the slot sides and proximate the substrate.

29. A golf club head comprising:

a body having a striking hoe and a sole, wherein a recess is formed in the sole, the recess having a recess wall;

wherein the sole recess includes an elongated slot formed in the sole, extending from a heel of the club head to a toe of the club head;

an insert located within the sole recess, the insert including a core and an intermediate layer that at least partially separates the core from the recess wall;

wherein the core of the insert comprises a substrate having interstices;

wherein the intermediate layer of the insert comprises a separate material that is disposed within the interstices of the substrate and that is located at least partially between the substrate and the recess wall; and wherein the intermediate layer has a hardness and a modulus of elasticity that are less than that of the core, such that when the golf club head is used to strike a golf ball, the resulting vibrations are dissipated by compression of the intermediate layer and movement of the core with respect to the intermediate layer.

30. A golf club head comprising:

a body having a striking face and a sole, wherein a recess is formed in the sole, the recess having a recess wall;

wherein the sole recess includes an elongated slot formed in the sole, extending from a heel of the club head to a toe of the club head;

an insert located within the sole recess, the insert including a core and an intermediate layer that at least partially separates the core from the recess wall;

wherein the core of the insert comprises an elongated substrate;

wherein the intermediate layer of the insert comprises a sleeve that at least partially surrounds the substrate, the sleeve being disposed between the substrate and the recess wall; and wherein the intermediate layer has a hardness and a modulus of elasticity that are less than tat of the core, such that when the gaff club head is used to strike a golf ball, the resulting vibrations are dissipated by compression of the intermediate layer and movement of the core with respect to the intermediate layer.

* * * * *